US006252757B1

(12) United States Patent
Loughney et al.

(10) Patent No.: US 6,252,757 B1
(45) Date of Patent: Jun. 26, 2001

(54) STATIC BRUSHES AND METHODS OF FABRICATING SAME

(75) Inventors: David H. Loughney, Phelps; John L. McKinney, Manchester; Edward W. Norton, Canandaigua, all of NY (US)

(73) Assignee: Ultrafab, Inc., Farmington, NY (US)

( * ) Notice: Subject to any disclaimer, the term of this patent is extended or adjusted under 35 U.S.C. 154(b) by 0 days.

(21) Appl. No.: 09/359,504

(22) Filed: Jul. 23, 1999

(51) Int. Cl.[7] ..... A46D 1/00; H05F 3/00
(52) U.S. Cl. ..... 361/221; 361/220; 300/21
(58) Field of Search ..... 361/212, 220, 361/221; 300/21

(56) References Cited

U.S. PATENT DOCUMENTS

| | | | | |
|---|---|---|---|---|
| 2,449,668 | * | 9/1948 | Peterson | 300/21 |
| 3,352,604 | * | 11/1967 | Melcher | 300/21 |
| 3,689,117 | * | 9/1972 | Hules | 300/21 |
| 3,914,817 | | 10/1975 | Lindsay . | |
| 4,124,875 | | 11/1978 | Van Zantwyk . | |
| 4,330,349 | * | 5/1982 | Swift et al. | 300/21 |
| 4,378,226 | | 3/1983 | Tomibe et al. . | |
| 4,690,854 | | 9/1987 | Tomibe et al. . | |
| 4,801,270 | | 1/1989 | Scarlata . | |
| 5,245,386 | | 9/1993 | Asano et al. . | |
| 5,338,382 | | 8/1994 | Johnson et al. . | |
| 5,424,116 | | 6/1995 | Takahashi . | |
| 5,593,618 | | 1/1997 | Okoniewski et al. . | |
| 5,689,791 | | 11/1997 | Swift . | |

* cited by examiner

*Primary Examiner*—Fritz Fleming
(74) *Attorney, Agent, or Firm*—Martin Lukacher; Kenneth J. Lukacher

(57) ABSTRACT

Static brushes suitable for handling electric charges so as to obtain static electricity control including static discharge in web handling devices such as printers, presses, xerographic copiers and other film and paper handling equipment is made of conductive thread wound in continuous turns around a mandrel and slit to form open-ended loops forming the brush bristles. A continuous element or elements, such as a wire or wires, may be placed on the mandrel and the turns are wound thereon. Strips of pressure-sensitive tape are adhered along the sides of said loops and encompass the element(s) so as to hold the loops and elements assembled as unitary brushes, which may readily be installed in equipment requiring static control by removing releasable paper over pressure-sensitive material on the outside of these strips. Double-sided pressure-sensitive adhesive tape may be used in constructing the brushes. The continuous elements (wires) prevent release of the threads of individual loops from the brushes when pulling forces are applied to the bristles. The mandrel is an endless loop on which thread winding, wire placement and pressure-sensitive adhesive tape application may be carried out progressively as the endless mandrel rotates. Effective, both operationally and in cost, static brushes are thereby provided.

14 Claims, 2 Drawing Sheets

STATIC BRUSHES AND METHODS OF FABRICATING SAME

DESCRIPTION

The present invention relates to static brushes and methods of making same. The static brushes provided by the invention are especially suitable for use in web and film handling equipment such as xerographic copiers and in printers, where they may be used in static electricity control, for example to discharge static electricity from the moving web.

Static brushes which have been proposed are made up of bristles of conductive fabric which may be formed from conductive thread such as yam and filament material. Such thread is commercially available and may for example be acrylic material which is soaked in a copper emulsion. Examples of such conductive thread are disclosed in the following U.S. Patents: Okoniewski et al, U.S. Pat. No. 5,593,618, Jan. 14, 1997; Tomibe et al, U.S. Pat. No. 4,378,226, Mar. 29, 1983; Takahashi, U.S. Pat. No. 5,424,116, Jun. 13, 1995; and Tomibe et al, U.S. Pat. No. 4,690,854, Sep. 1, 1987.

Fibers coated for conductivity are also shown in Swift, U.S. Pat. No. 5,689,791, Nov. 18, 1997 which also exemplifies the conventional static brush structures wherein pile of conductive fibers is attached to a base or core member. The bristles may also be in loops which are clamped at one end thereof as shown in VanZantwyk, U.S. Pat. No. 4,124,875, Nov. 7, 1978; Lindsay, U.S. Pat. No. 3,914,817, Oct. 28, 1975 and Asano et al, U.S. Pat. No. 5,245,386, Sept. 14, 1993. Tufts of conductive fiber may also be stitched together to form static brush. Such stitched brushes are commercially available. Such known brushes, and especially carbon tufted brushes with clamp backing members, have a limited useful life and must often be replaced.

It is the principal object of the invention to provide an improved static brush which is reliable over a commercially practicable lifetime.

It is another object of the present invention to provide an improved brush having means for preventing the loss of conductive brush segments, such as threads which make up the bristles of the brush.

It is another object of the present invention to provide an improved method for fabricating static brushes rapidly, in a continuous fabrication operation.

Briefly described, a static brush embodying the invention is made up of a helical winding of conductive thread in successive loops having open ends and also sides which extend around a closed bottom of the loops, strips, preferably of adhesive material extend along the sides of the loops and hold the loops in assembled relationship. The strips may be pressure-sensitive adhesive tape and particularly double-sided tape, one side of which is adhered to the loops and the other side of which is covered by release material which may be removed to facilitate the installation of the brush as and where required. In order to prevent removal of the brush bristle, made up of the loops of thread, a continuous element, such as a wire of conductive material may be placed within the loops, in the process of helically winding the thread. The element lies adjacent the closed bottom of the loops and resist removal of the threads constituting the loops. These static brushes may be fabricated by winding the thread around an endless mandrel, along which the continuous element may be placed. The pressure-sensitive strips may be unwound from reels and adhered to the sides of the loops. The loops may be slit to form a brush or a pair of brushes.

The foregoing and other objects, features and advantages of the invention will become more apparent from a reading of the following description in connection with the accompanying drawings which are briefly described as follows:

Figure 1:
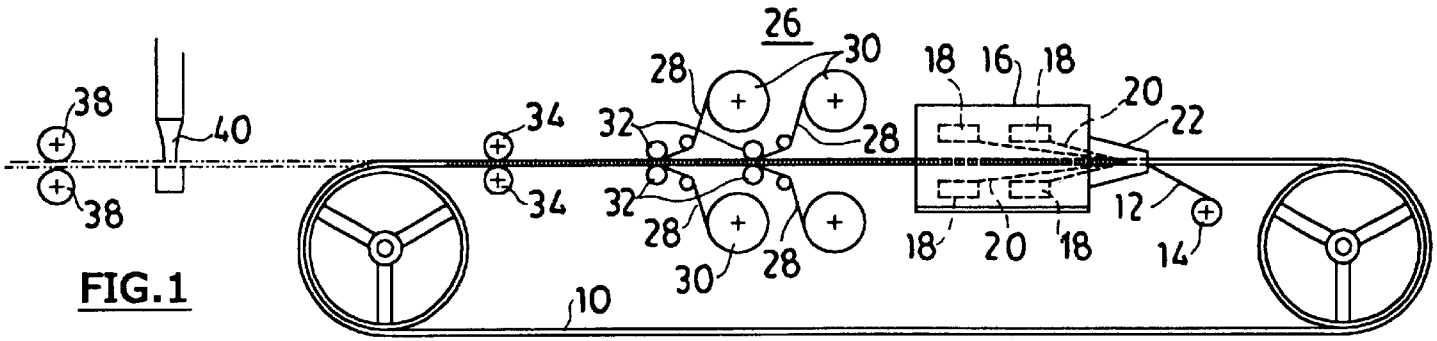
FIG. 1 is a side elevational view, schematically illustrating apparatus for producing static brushes, the brushes and method of operations of the apparatus embodying the invention.
Figure 2:
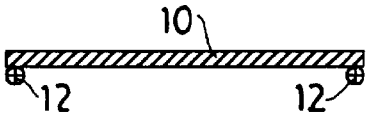
FIGS. 2–6 are sectional views, illustrating progressive steps in the process of manufacturing static brushes utilizing the apparatus shown in FIG. 1.
Figure 3:
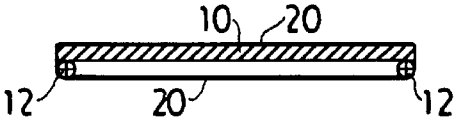
Figure 7:
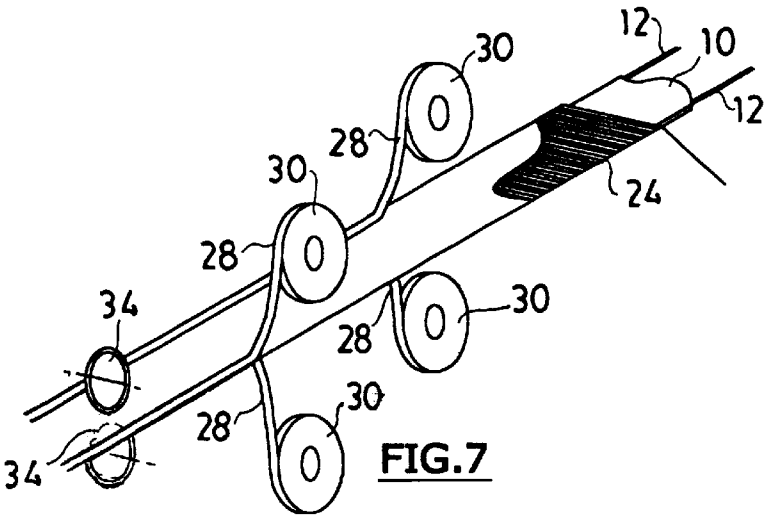
FIG. 7 is a perspective view, schematically illustrating the apparatus shown in FIG. 1 carrying out the progressive steps illustrated in FIGS. 2–6.
Figure 8:
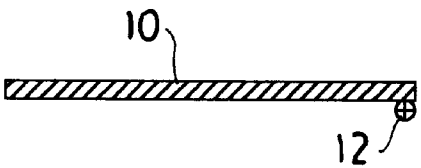
FIGS. 8–12 are sectional views, similar to FIGS. 2–6, illustrating progressive steps in the fabrication of a static brush have bristles longer than the brush produced when the machine is operated, carrying out the progressive steps illustrated in FIGS. 2–6.
Figure 9:
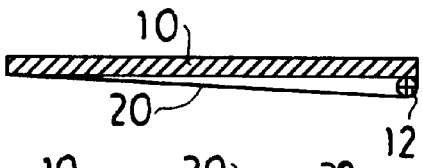
Figure 10:
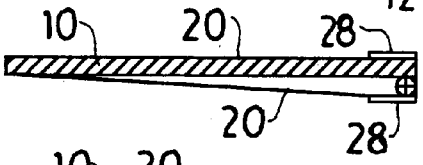
Figure 11:
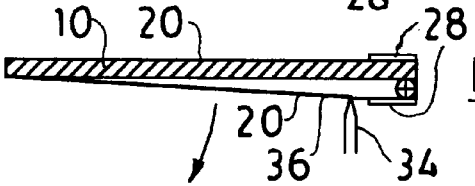

There is shown in FIG. 1 apparatus 9 for fabricating static brushes in accordance with the invention. Similar apparatus is used in the fabrication of weather stripping, but must be modified to carry out the method of this invention. An example of such apparatus is show in U.S. Pat. No. 5,338,382 issued Aug. 16, 1994 to Johnson, et al. The apparatus includes an endless mandrel 10 which is continuously driven in a counterclockwise direction as viewed in FIG. 1. First, as shown in FIG. 2, continuous elements, preferably conductive wires 12 from spools 14 are introduced and placed along the longitudinal edges of the rectangular (in cross section) mandrel 10. The diameter of the wire 12 is enlarged for illustration and may be about the same order as the strands of thread. A winding station 16 contains four spools 18 of conductive thread 20. A thread winding cone 22 winds multiple thread strands of the threads in helical turns around the mandrel, encompassing the wires 12, as shown in FIG. 3. The turns 24 of the strands are also illustrated in FIG. 7.

Figure 4:
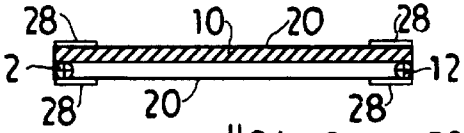
Figure 5:
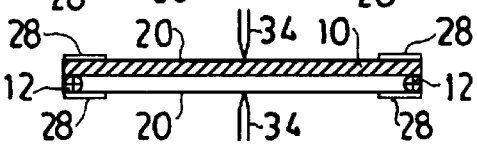

The next station 26 applies double-sided, pressure-sensitive adhesive tapes 28 from four reels 30. The underside of these tapes 28 has pressure-sensitive material, while the outside of the tapes has a release covering (usually paper) thereon. The tapes are pressed by pressure rollers 32 against the turns 24 of thread strands and the mandrel 10, and are located near the longitudinal edges of the mandrel in parallel relationship. See FIG. 7 and FIG. 4. Pressure rolls 32 apply the tape so that the pressure-sensitive sides adhere to the strands and encompass the wires, thereby capturing the strands and wires and holding them in assembled relationship. (See also FIG. 4) The relationship of the reels 30 so that the tape is applied in parallel relationships on opposite sides of the turns 24 is best shown in FIG. 7.

Figure 6:
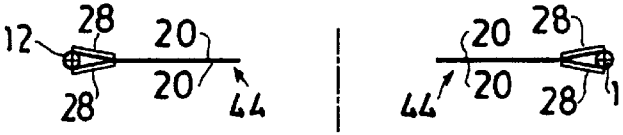
Figure 12:
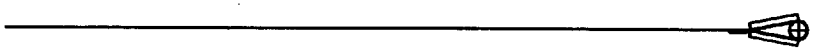
Figure 13:
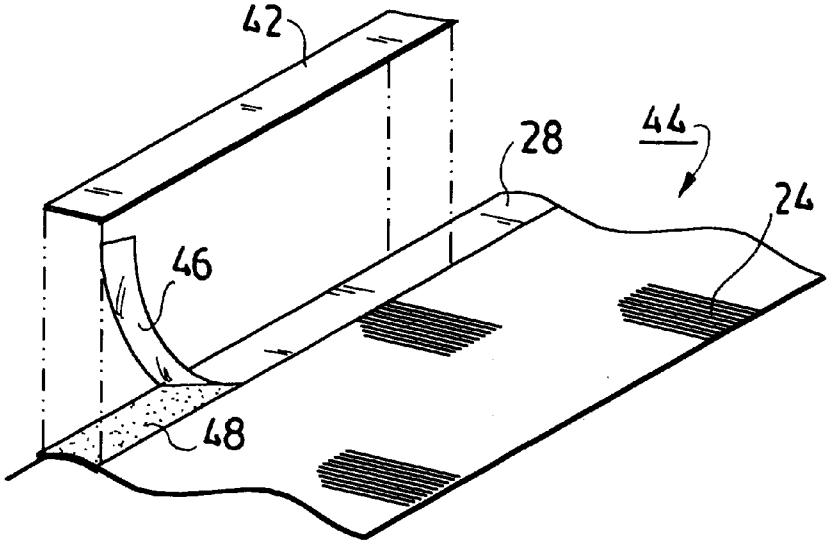
FIG. 13 is a perspective view, illustrating a static brush embodying the invention having a metal or plastic strip along the adhesively-covered edge of the brush so as to provide a mounting member to facilitate the installation of the brush on a machine requiring static discharge of an element such as a sheet of paper which moves past the brush.

After the tape 28 is applied, the turns 24 are slit by slitting cutter wheels 34. The slitting is in the middle of the mandrel if two brushes 44 are desired. If one brush 45 having bristles with longer sides is to be fabricated (such a brush 45 is illustrated in FIG. 13), then only one wire 12 is used and also one slitting wheel 34 is used. The progression of steps in fabricating the single loop static brush of FIG. 13 is illustrated in FIGS. 8, 9, 10 and 12. The portion 36 of the turns after slitting may be stretched out to provide a brush longer on one side than the other as shown in FIG. 12. FIG. 6 shows a pair of unitary brushes which are made two at the same time in the apparatus of FIG. 1.

The brushes may be pulled off the mandrel by drive rollers 38. In the event that stronger adherence of the tape to the loops of the brushes is desired, the tapes may be locally heated, as with ultrasonic horns 40. Such heating causes the adhesive material adjacent to the loops of thread to flow into, around and between the threads to increase the adherence of the tape to the threads. A feature of such heating is that it enables the conductivity of the brush to be controlled or selected.

Referring to FIG. 13, there is shown a metal or plastic strip 42. The strip 42 may be sufficiently thick to be rigid and provide a mounting support for the releasible paper 46 on the adhered tape 28 to be removed and the strip 42 is pressed against the pressure-sensitive material 48 which is exposed after removal of the paper covering 46. The operation may be done on-site when the brush 44 is ready to be assembled on the apparatus requiring static control. The brush 44 may be shipped, wound on a reel, thereby facilitating handling and storage thereof.

The sides of the loops of thread form the bristles of the brush. The sides are sufficiently rigid, and the threads 20 are closely packed in the course of winding on the mandrel 10, so that the bristles remain upright even though they are held only by the tapes 28. In an exemplary brush, the threads may be polypropylene threads which are soaked in a copper emulsion so as to make them conductive. The threads are wound in double strands in a linear density of 10 to 100 strands per inch. The tapes 28 may be ⅜ to 1 inch wide. The height of the sides from the closed bottom of the loops to the free ends may be ¾ to 1½ inches. The wire may be 0.0055 diameter soft, stainless steel (e.g., 303). However, the wire may have multiple strands, which strand, may be of interlaced or braided. The wire(s) also enhances the conductivity of the brush. The charge (as presented by the voltage) which the brush is required to dissipate may be controlled or selected by selecting the conductivity of the wire(s) and the thickness of the adhesive. It will be appreciated that the showings of the cross sections of the brushes in FIGS. 6 and 12 are simplified and schematic and not to scale. This was done to facilitate the illustration.

When the brush is installed, sufficient conductivity is provided by the bristles of the brush and the support for the brush via the compressed pressures-sensitive adhesive which attaches the brush to the support, even though the adhesive is not conductive. the conductivity of the brush may be controlled or selected by varying the thickness of the adhesive.

From the foregoing description, it will be apparent that there has been provided improved static brushes and methods of making same. Variations and modifications in the herein-described brushes and manufacturing methods will undoubtedly suggest themselves to those skilled in the art. Accordingly, the foregoing description should be taken as illustrative and not in a limiting sense.

What is claimed is:

1. A static brush comprising a continuous conductive strand element, a helical winding of conductive thread slit to define the ends of bristles provided by successive loops of the thread around the element, said conductive element and thread having diameters of the same order, a base for supporting said bristles provided principally by side strips of flexible material along the length of said loops straddling said element and sandwiching and capturing said bristles and said element to support said bristles and said element in assembled relationship to provide a unitary brush.

2. A static brush comprising a helical winding of conductive thread providing bristles of successive loops of the thread, the loops having open ends and sides extending around the closed bottom of said loops, a base for said brush provided principally by strips of flexible tape extending along said sides and attached thereto and holding said loops and supporting said bristles in assembled relationship to provide a unitary brush.

3. The brush according to claim 2 further comprising a continuous flexible strand element sandwiched between said strip sides and disposed inside said closed bottom to prevent separation of the threads of said loops from said brush.

4. The brush according to claim 2 wherein one of said sides of each of said loops is longer than the other.

5. The brush according to claim 2 wherein said strips are pressure-sensitive adhesive tape.

6. The brush according to claim 5 wherein said tape has adhesive on opposite sides, one of said tape sides being adhesively attached to said loops and the other having a releasible covering.

7. The brush according to claim 6 further comprising a strip of metal or plastic attached to said adhesive material on said other side of said tape in place of said releasible covering.

8. The brush according to claim 2 wherein said element comprises a wire of conductive material.

9. A method of fabricating a static brush comprising the steps of winding a conductive thread around a continuously movable and generally rectangular in cross-section mandrel to form around said mandrel a plurality of successive turns having sides, adhering a pair of pressure-sensitive adhesive strips paralleling each other along the sides of said turns, compressing said strips against said turns and said mandrel, slitting said turns and removing said turns and their adhering strips from said mandrel to provide bristles of at least one brush of loops of said turns open at one end.

10. The method according to claim 9 further comprising the step of placing at least one continuous element along said mandrel prior to said winding step.

11. The method according to claim 10 wherein said mandrel is generally rectangular and has opposite longitudinal edges, said placing step locating said at least one wire adjacent to one of said edges.

12. The method according to claim 11 wherein said placing step is carried out to located another continuous element along the other of said opposite edges.

13. The method according to claim 9 wherein said strips are coated with pressure-sensitive adhesive and further comprising the step of locally heating said strips so as to enhance the flow of said adhesive material to said turns.

14. The method of claim 10 wherein said placing step is carried out with conductive wire as the continuous element.

* * * * *